United States Patent [19]

Kågström

[11] 4,101,154

[45] Jul. 18, 1978

[54] LOCKING DEVICE FOR WELL COVERS AND THE LIKE

[76] Inventor: Rune Kågström, 36a, Tunbyvägen, Västerås, Sweden, S-722 23

[21] Appl. No.: 733,939

[22] Filed: Oct. 19, 1976

[30] Foreign Application Priority Data

Oct. 21, 1975 [SE] Sweden ..... 7511782

[51] Int. Cl.[2] ..... E05C 3/06

[52] U.S. Cl. ..... 292/237

[58] Field of Search ..... 292/237, 238, 338, 53, 292/54, 256–265; 52/21; 404/25, 26

[56] References Cited

U.S. PATENT DOCUMENTS

| | | | |
|---|---|---|---|
| 393,264 | 11/1888 | Reed | 292/53 |
| 862,746 | 8/1907 | Martin | 292/237 X |
| 897,046 | 8/1908 | Armstrong | 404/25 X |
| 2,217,996 | 10/1940 | Sasgen | 292/338 |
| 3,530,696 | 9/1970 | Dunmire | 404/25 X |

*Primary Examiner*—Richard E. Moore
*Attorney, Agent, or Firm*—Wenderoth, Lind & Ponack

[57] ABSTRACT

The disclosure relates to a device for locking the lids or covers of wells and similar constructions, a locking mechanism which is actuable from the outside being disposed on the underside of the cover.

The novel feature of the invention is that the locking device comprises at least one lever serving as a locking arm and engaging with the wall of the well. These arms are of such length in relation to the size of the well opening and of such inclination in position of engagement with the walls of the well that, on attempts to lift the cover, the locking arms or levers will be urged against the walls of the well with increased force in relation to the lifting force. Furthermore, the locking device is of such a nature that it is self-locking when the cover is put in place but must be deactuated prior to removal of the cover.

17 Claims, 4 Drawing Figures

LOCKING DEVICE FOR WELL COVERS AND THE LIKE

BACKGROUND OF THE INVENTION

The present invention relates to a locking device for covers, gratings and lids for gullies, manholes, shafts, etc., which device includes a locking means operable from the upper or outer side of the cover so as to engage with the wall of the well inside the cover.

Covers over gully holes, manholes for culverts and wells are normally allowed to rest freely in place in the hope that unauthorized persons will be unable to open the cover because of its weight and cumbrousness. However, a great number of accidents in which people have fallen down in wells and manholes has shown that there is a need for an effective and reliable locking mechanism. One prior art proposal is that relatively small covers should be provided with hooks which could by snap action be brought to engage with corresponding hooks provided on the brim of the well. Locking bolt devices have also been proposed in the art, the brim of the well being provided with recesses which these devices could be caused to enter for the purposes of locking the cover. These prior art apparatuses have not gained any appreciable commercial success, the reason supposedly being that they have complicated the manufacture of the covers, or that the locking mechanism has been put out of operation by rust or dirt.

SUMMARY OF THE INVENTION

The object of the present invention is to provide a locking device which, in a very simple manner, can be mounted to any type of well cover; which provides a totally reliable locking irrespective of the shape of the well or well brim; and which, because of its construction, is only to a minimal extent affected by corrosion, malicious mischief, etc.

According to the invention, the locking device comprises at least one lever serving as a locking member, the lever being pivotal, by means of an operating device, about a journal located parallel to the well cover and non-displaceable in a direction away from the cover, the operating device being actuable from the outer side of the well cover. Moreover, the free end of the lever is intended to engage with the wall of the well, whereas a second end is arranged to be actuated by the operating device. Furthermore, the locking device includes at least one abutment means which prevents the end of the lever in engagement with the well wall from lateral shifting in the direction of the cover plane away from and out of engagement with the above-mentioned wall. Finally, the lever is of such length and is localized in relation to the the positionally fixed journal such that the lever end engaging with the well wall is located closer to the cover than is the lever journal.

BRIEF DESCRIPTION OF THE DRAWINGS

The nature of the invention and its aspects will be more readily understood from the accompanying drawings, and discussion relating thereto. In the accompanying drawings.

DETAILED DESCRIPTION OF THE INVENTION

Figure 1:
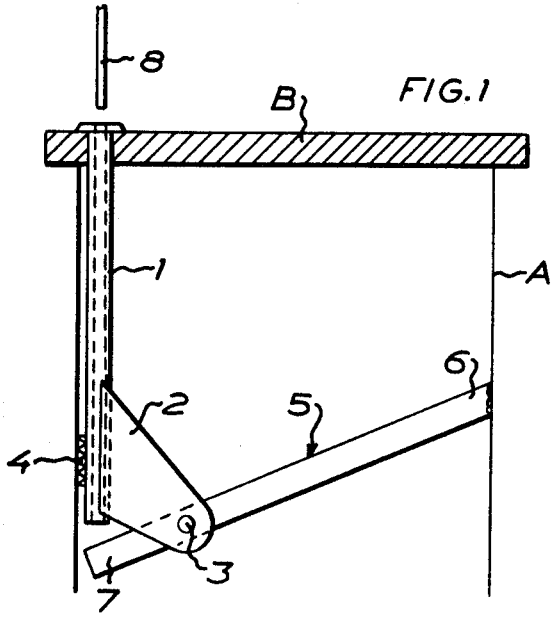
FIG. 1 is a front elevation of a simple embodiment of the device according to the present invention.

In the drawings, details having similar function or of similar type have been given identical reference numerals.

A well or pit which may consist of a sinkhole, a manhole or a gully is designated A. The well which, as a rule, is formed of concrete pipes, is closed at the top by means of a cover or grating B. The drawings show a cover, but it is obvious that the locking device according to the invention may equally well be used in conjunction with gratings or the like.

The device in the embodiment according to FIG. 1 consists of one fixed and one movable part. The fixed part consists of a sleeve 1 fixed in an opening provided in the cover B and extending a distance down into the well A. At the lower end of the sleeve, a journal 3 is provided at a pair of lugs or the like 2. At the opposite side of the sleeve 1 an abutment surface 4 is provided which is located such that, when the cover B is in the correct position, it abuts against the wall of the well A.

The movable part consists of a two-armed lever 5 which serves as a locking means or locking arm and is pivotal about the journal 3. The length of the arm is adapted such that the total horizontal extent of the arm and the fixed part is greater than the cross-sectional dimension of the well. The arm 5 is balanced or disposed such that its outer end 6 tends to pivot downwardly so that the end 7 projecting under the sleeve 1 pivots upwardly.

In the embodiment shown in FIG. 1, the sleeve 1 is eccentrically placed at the well cover, but it is obvious that it could also be placed in the centre of the cover. In such a case, the sleeve is provided with a fixed projection whose outer end forms the abutment surface 4.

The cover with the locking device mounted thereon is set in place in the normal manner, care being taken to see that the cover is centred on the well so that the abutment surface 4 will abut against the wall of the well. As the cover is mounted in place, the arm or lever 5 will, with its outer end, slide towards the well wall and, when the cover is firmly in place, assume an obliquely upwardly sloping position. The cover is thereby locked. If the cover is lifted, the outer end 6 of the arm 5 will be urged against the well wall, the arm 5 actuating, by the intermediary of the journal 3, the sleeve 1 and urging its abutment surface 4 against the opposite wall. The size of the abutment forces increases by the force with which the cover is lifted.

The locking device is inactuated in that a rod 8 adapted to fit in the opening of the sleeve 1 and serving as an operating member is pushed down into the sleeve so that it strikes the end 7 of the arm 5 and pushes it downwards. The engagement between the arm end 6 and the well wall then ceases and the cover can be lifted.

In certain types of covers, the fitting of the cover so that a fixed abutment surface comes into abutment with the well wall can be troublesome.

Figure 2:
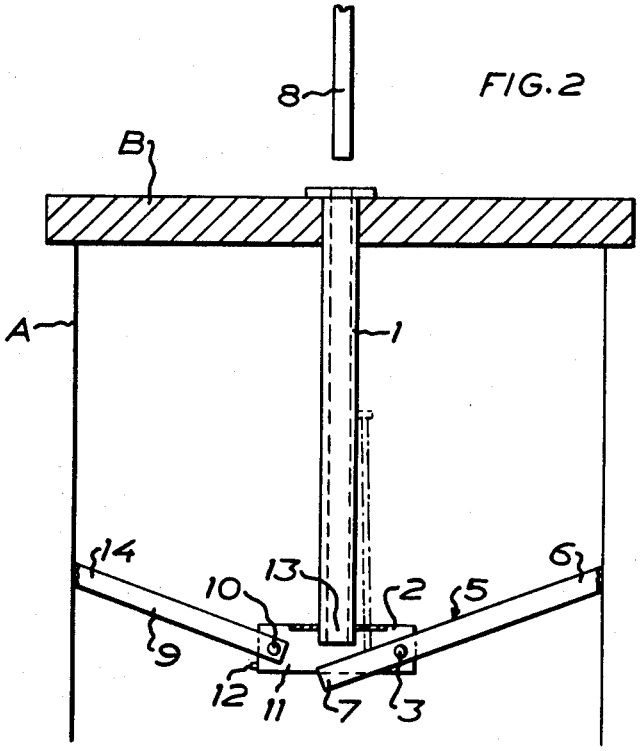
FIG. 2 is a front elevation of a second embodiment of the device according to the invention.

In such wells or covers, the embodiment according to FIG. 2 can be used. This embodiment differs from that of FIG. 1 in that the fixed abutment 4 has been replaced by a movable rod 9. The rod 9, which is designed as a one-armed lever, is pivotal about a journal 10 fixed to projections 11 at the opposite side of the sleeve 1, seen from the journal 3. The rod can pivot freely upwardly, but is prevented by a stop 12 from reaching or passing the horizontal position. Neither may the locking arm or lever 5 pivot fully down to or past the horizontal position, the lever arm being prevented from such action in that the inner end 7 of the arm engages with the lower end 13 of the sleeve 1.

In the embodiment according to FIG. 2, the sleeve 1 is mounted at the middle of the cover. When the cover is put in place, the locking arm 5 and the abutment arm 9, will, with their outer ends 6 and 14, respectively, slide against the well wall and stop in abutment against the wall when the cover is in place. If the cover is lifted without deactivation of the locking device, the ends 6 and 14, respectively, of the rods 5 and 9 will be urged against the well wall and retain the cover. In this case, the locking device is also released by means of a rod 8 which is inserted down through the sleeve and pivots the arm 5.

Instead of using the gravitational force acting on the lever or locking arm 5 and balancing this force such that the lever tends to assume its locking position, it is possible to provide the locking arm with a spring means suggested in FIG. 2 by broken lines, the spring means being suitable in the form of a rubber spring.

It is clear that the locking device can also be designed so that it engages at three points on the well wall, the arms, which in such a case suitably make an angle of 120° with each other, consisting possibly of two abutment arms 9 and an exteriorly operable locking arm 5.

Naturally, it is also possible to dispense with the abutment arm 9 and replace it with a further exteriorly operable arm similar to arm 5.

In an adaptation of a locking device so as to fit a well it is merely necessary to see to it that the locking arm (in the one case) and the locking arm and abutment arm (in the other case) are of such length that the angle between the arm and the well wall in the position of engagement is not less than about 45°. Well sizes are relatively few in number and it is possible either at the manufacture stage to provide complete locking devices adapted for each respective well size or to supply the locking devices together with interchangeable locking arms of adapted length. A further alternative is locking devices with arms of adjustable length.

Figure 3:
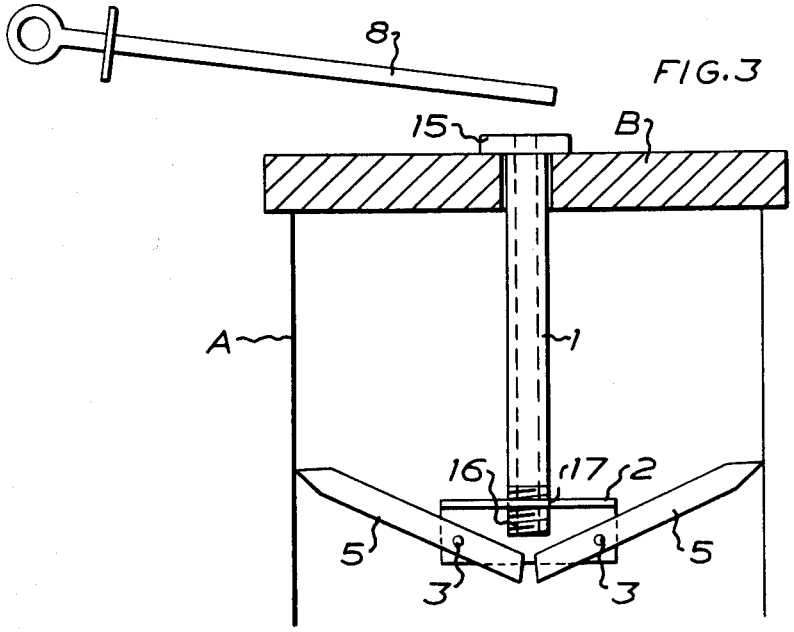
FIG. 3 is a front elevation of a further embodiment in the operative position.

In the embodiment shown in FIG. 3, a well cover is, as previously, designated B. A hole is provided in the cover for the sleeve 1, the hole being of such a size as to permit the sleeve 1 easy passage therethrough. The sleeve has, at its upper end, a collar 15 which abuts against the edge of the hole. At its lower end, the sleeve 1 is provided with a threaded portion 16 which, once the sleeve has been inserted into the hole, is threaded in a hole 17 of corresponding threading in a transverse piece 2 at which journals 3 forming the lever shafts are mounted.

In this embodiment, both of the levers 5 serving as locking arms are intended to be operated by the operating means which, as in previous embodiments, consists of a rod 8 which may be inserted from above through the opening of the sleeve 1 into engagement with the inner ends 7 of the levers 5.

A considerable advantage inherent in the embodiment according to FIG. 3 is that the transverse piece 2 and the levers 5 can, on placing and removing of the cover, be kept lifted-up against the cover, thereby not obstructing handling of the cover. When the cover is in place, the sleeve is released, the levers sliding along the well walls and coming into engagement with these walls.

In, for example, covers in the form of gratings, it has in certain cases proved to be less advisable to place the locking device adjacent the grating since unauthorized persons can manipulate the levers through openings in the grating and possibly move the levers out of engagement. For this particular purpose, the modification according to FIG. 4 has been developed. As regards the levers 5, the sleeve 1 and the transverse piece, this embodiment corresponds to that shown in FIG. 3. However, instead of making the sleeve 1 pass through a hole in the grating cover B', the upper end of the sleeve 1 is connected to the grating cover by means of a flexible connexion member 18 in the form of a chain or wire.

Furthermore, a guide in the form of a disk 19 (which is suitably perforated) is mounted at the upper end of the sleeve and is adapted in dimensions to the well opening. The disk 19 which may be replaced by radially projecting ribs which are united by an outer ring or the like, has for its object to ensure, in conjunction with the mounting operation, that the sleeve 1 is oriented substantially vertically in the well.

The flexible connexion member also provides the advantage that it is possible without difficulty to compensate for lateral deviation between the grating cover and the well. Grating covers are often adapted in view of the street or ground covering and this can entail that a previously sunk well can be offset laterally relative to the grating cover and its frame.

Figure 4:
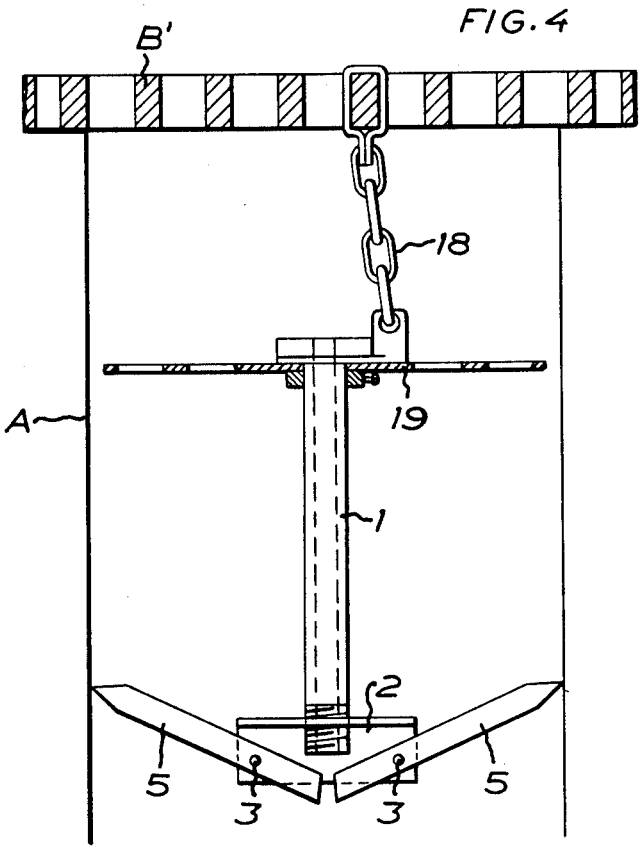
FIG. 4 is a front elevation of a modification of the embodiment according to FIG. 3.

In mounting the apparatus according to FIG. 4, the locking device is first inserted into the well with the disk or the like 19 serving as a guide, whereupon the grating cover connected to the sleeve by means of the chain or the like 18 is put in place. Once the chain 18 is stretched, the locking device comes into operation and fixes the grating cover.

Removal is effected as earlier by means of the rod 8 which, to this end, should be inserted down through the grating cover and into the sleeve opening on the upper side of the disk 19.

As regards the sleeve opening and the rod it is naturally possible in all embodiments to obtain a more pronounced lock-key effect by, for example, giving the sleeve opening, or the opening of a disk fixed thereto, an unusual shape and by giving the rod 8 a cross-sectional profile which corresponds to the shape of such an opening. Since the rod 8 need not be exposed to any great stresses, it can in a simple manner be given the contemplated shape by, for example, extrusion or by slitting a tube or a rod.

The invention should not be considered as restricted to the three embodiments described in the specification and shown on the drawings, but may be modified in several ways within the spirit and scope of the claims.

What I claim and desire to secure by Letters Patent is:

1. A locking device for use in locking a removable lid such as a cover, a well grating or the like over an opening of a straight-walled hole such as a well, a manhole, a shaft or the like, said locking device comprising:

at least one locking member in the form of a lever pivotally mounted about a journal;

means, separate from a lid, for mounting said journal with respect to the lid such that said journal extends in a direction parallel to the plane of the lid and such that said journal is immovable in a direction away from the lid;

said lever having a first end and a second end, and said lever being automatically pivotable about said journal such that said first end automatically engages with a first straight wall surface of a hole to be covered by the lid;

at least one abutment means, mounted on said mounting means, for abutting against a second straight wall surface of the hole when said first end of said lever abuts against said first straight wall surface and for preventing lateral shifting of said first end of said lever out of engagement with said first straight wall surface, thereby locking the lid in the hole covering position thereof;

the sum of the distance between said first end of said lever and said journal and the distance between said journal and said abutment means being greater than the straight line distance between said first end and said abutment means;

said first end of said lever when engaging said first straight wall surface being closer to the lid than is said journal; and operating means, operable from the outside of the lid and extendable through at least a portion of said mounting means, for engaging said second end of said lever and for pivoting said lever about said journal such that said first end of said lever is disengaged from said first straight wall surface, thereby unlocking the lid from the hole.

2. A locking device as claimed in claim 1, wherein said abutment means comprises a further lever mounted on said mounting means in a manner similar to the mounting of said lever forming said locking member and extending from said mounting member in a direction opposite to that of said lever forming said locking member.

3. A locking device as claimed in claim 2, wherein said further lever includes an end contacted by said operating means where said operating means contacts said second end of said lever, said operating means thus being means for pivoting said further lever out of engagement with said second straight wall surface.

4. A locking device as claimed in claim 2, wherein said further lever is pivotally mounted on said mounting means to pivot by gravity into contact with said second straight wall surface.

5. A locking device as claimed in claim 2, further comprising spring means for pivoting said further lever into engagement with said second straight wall surface.

6. A locking device as claimed in claim 1, wherein said abutment means comprises an abutment fixed to said mounting means and immovable with respect to said journal, said abutment extending from said mounting member in a direction opposite to that of said lever.

7. A locking device as claimed in claim 1, wherein said lever automatically pivots by gravity about said journal to a position such that said first end of said lever engages said first straight wall surface.

8. A locking device as claimed in claim 1, further comprising spring means for automatically pivoting said lever about said journal to a position such that said first end of said lever engages said first straight wall surface.

9. A locking device as claimed in claim 1, wherein said mounting means comprises a straight sleeve having a first end and a second end, means at said first end of said sleeve for inserting said sleeve through the lid, means at said second end of said sleeve for supporting said journal, said sleeve having a longitudinal opening therethrough dimensioned for extension therethrough of said operating means, and said second end of said lever facing said sleeve opening.

10. A locking device as claimed in claim 1, wherein said mounting means comprises a straight sleeve having a first end and a second end, flexible coupling means for fixedly attaching said first end of said sleeve to the lid at a position spaced from the lid, means at said second end of said sleeve for supporting said journal, said sleeve having a longitudinal opening therethrough dimensioned for extension therethrough of said operating means, and said second end of said lever facing said sleeve opening.

11. In an assembly including a hole such as a well, a manhole, a shaft or the like, said hole being entirely defined by straight wall surfaces and having an opening, a lid such as a cover, a well grating or the like removably mounted to cover said hole opening, and a locking device for locking said lid in a position covering said hole opening, the improvement wherein said locking device comprises:

at least one locking member in the form of a lever pivotally mounted about a journal;

means for mounting said journal with respect to said lid such that said journal extends in a direction parallel to the plane of said lid and such that said journal is immovable in a direction away from said lid;

said lever having a first end and a second end, and said lever being automatically pivotable about said journal such that said first end automatically engages with a first straight wall surface of said hole;

at least one abutment means, mounted on said mounting means, for abutting against a second straight wall surface of said hole when said first end of said lever abuts against said first straight wall surface and for preventing lateral shifting of said first end of said lever out of engagement with said first straight wall surface, thereby locking said lid in the hole covering position thereof, said abutment means comprising a further lever mounted on said mounting means in a manner similar to the mounting of said lever forming said locking member and extending from said mounting means in a direction opposite to that of said lever forming said locking member;

the sum of the distance between said first end of said lever and said journal and the distance between said journal and said abutment means being greater than the straight line distance between said first end and said abutment means;

said first end of said lever when engaging said first straight wall surface being closer to said lid than is said journal;

operating means, operable from the outside of said lid and extendable through at least a portion of said mounting means, for engaging said second end of said lever and for pivoting said lever about said journal such that said first end of said lever is disengaged from said first straight wall surface, thereby unlocking said lid from said hole; and said further lever including an end contacted by said operating means when said operating means contacts said second end of said lever, said operating means thus being means for pivoting said further lever out of engagement with said second straight wall surface.

12. The improvement claimed in claim 11, wherein said further lever is pivotally mounted on said mounting means to pivot by gravity into contact with said second straight wall surface.

13. The improvement claimed in claim 11, further comprising spring means for pivoting said further lever into engagement with said second straight wall surface.

14. The improvement claimed in claim 11, wherein said lever automatically pivots by gravity about said journal to a position such that said first end of said lever engages said first straight wall surface.

15. The improvement claimed in claim 11, further comprising spring means for automatically pivoting said lever about said journal to a position such that said first end of said lever engages said first straight wall surface.

16. In an assembly including a hole such as a well, a manhole, a shaft or the like, said hole being entirely defined by straight wall surfaces and having an opening, a lid such as a cover, a well grating or the like removably mounted to cover said hole opening, and a locking device for locking said lid in a position covering said hole opening, the improvement wherein said locking device comprises:

at least one locking member in the form of a lever pivotally mounted about a journal;

a straight sleeve having a first end and a second end, said first end of said sleeve extending through said lid, means at said second end of said sleeve for supporting said journal such that said journal extends in a direction parallel to the plane of said lid and such that said journal is immovable in a direction away from said lid, said sleeve having a longitudinal opening therethrough;

said lever having a first end and a second end, and said lever being automatically pivotable about said journal such that said first end automatically engages with a first straight wall surface of said hole, said second end of said lever facing said sleeve opening;

at least one abutment means, mounted on said mounting means, for abutting against a second straight wall surface of said hole when said first end of said lever abuts against said first straight wall surface and for preventing lateral shifting of said first end of said lever out of engagement with said first straight wall surface, thereby locking said lid in the hole covering position thereof;

the sum of the distance between said first end of said lever and said journal and the distance between said journal and said abutment means being greater than the straight line distance between said first end and said abutment means;

said first end of said lever when engaging said first straight wall surface being closer to said lid than is said journal; and operating means, operable from the outside of said lid and dimensioned to extend through said sleeve opening, for engaging said second end of said lever and for pivoting said lever about said journal such that said first end of said lever is disengaged from said first straight wall surface, thereby unlocking said lid from said hole.

17. In an assembly including a hole such as a well, a manhole, a shaft or the like, said hole being entirely defined by straight wall surfaces and having an opening, a lid such as a cover, a well grating or the like removably mounted to cover said hole opening, and a locking device for locking said lid in a position covering said hole opening, the improvement wherein said locking device comprises:

at least one locking member in the form of a lever pivotally mounted about a journal;

a straight sleeve having a first end and a second end, flexible coupling means for fixedly attaching said first end of said sleeve to said lid at a position spaced from said lid, means at said second end of said sleeve for supporting said journal such that said journal extends in a direction parallel to the plane of said lid and such that said journal is immovable in a direction away from said lid, said sleeve having a longitudinal opening therethrough;

said lever having a first end and a second end, and said lever being automatically pivotable about said journal such that said first end automatically engages with a first straight wall surface of said hole, said second end of said lever facing said sleeve opening;

at least one abutment means, mounted on said mounting means, for abutting against a second straight wall surface of said hole when said first end of said lever abuts against said first straight wall surface and for preventing lateral shifting of said first end of said lever out of engagement with said first straight wall surface, thereby locking said lid in the hole covering position thereof;

the sum of the distance between said first end of said lever and said journal and the distance between said journal and said abutment means being greater than the straight line distance between said first end and said abutment means;

said first end of said lever when engaging said first straight wall surface being close to said lid than is said journal; and operating means, operable from the outside of said lid and dimensioned to extend through said sleeve opening, for engaging said second end of said lever and for pivoting said lever about said journal such that said first end of said lever is disengaged from said first straight wall surface, thereby unlocking said lid from said hole.

* * * * *